United States Patent [19]

Brennan

[11] 4,183,585

[45] Jan. 15, 1980

[54] LONGWALL MINING MACHINE

[75] Inventor: John T. Brennan, Oil City, Pa.

[73] Assignee: Joy Manufacturing Company, Pittsburgh, Pa.

[21] Appl. No.: 779,325

[22] Filed: Mar. 21, 1977

[51] Int. Cl.[2] ..... E21C 29/02

[52] U.S. Cl. ..... 299/43; 72/422; 72/462; 105/29 R

[58] Field of Search ..... 299/42, 43; 105/29 R, 105/29TL; 74/422, 462, 467, 468

[56] References Cited

U.S. PATENT DOCUMENTS

| | | | |
|---|---|---|---|
| 563,776 | 7/1896 | Lee et al. | 299/43 |
| 1,438,266 | 12/1922 | Schoberle | 105/29 R |
| 2,509,161 | 5/1950 | Meyers | 74/422 |
| 3,753,596 | 8/1973 | Pentith | 299/43 |
| 3,968,995 | 7/1976 | Arentzen | 37/191 A |

FOREIGN PATENT DOCUMENTS

| | | | |
|---|---|---|---|
| 2547826 | 4/1976 | Fed. Rep. of Germany | 299/43 |
| 443980 | 12/1974 | U.S.S.R. | 299/42 |

*Primary Examiner*—William Pate, III
*Attorney, Agent, or Firm*—Arnold B. Silverman

[57] ABSTRACT

A longwall mining system having a longwall mining machine and a conveyor operatively associated therewith. Haulage being effected through rack and pinion means. The pinion has roller means rotatably mounted on the pinion teeth. The conveyor rack has root sections sloping toward the conveyor path.

7 Claims, 10 Drawing Figures

182
210
172
48
26
A
54
178
46
204
206
B
56
202
192
48
38
26
44
54
182
210
172
184
174
196
192
9
9
46
56
186
194
176
188
178

LONGWALL MINING MACHINE

BACKGROUND OF THE INVENTION

1. Field of the Invention

This invention relates to longwall mining systems and more specifically relates to longwall mining haulage having unique pinion and rack members for use in such systems.

2. Description of the Prior Art

In longwall mining, a cutting machine which is used to extract minerals, such as coal, moves in a direction generally parallel to the mineral face and is provided with one or more rotary cutting drums which serve to engage the face and free the mineral. The mineral which has been freed is delivered to a conveyor positioned generally parallel to the mine face for removal from the mining site. Longwall miners are generally operated in a reversible fashion. After translational movement of the machine during a cutting operation in a first direction the direction of machine travel is reversed and cutting is effected while the machine moves in the opposite direction.

It has been known to employ various means for effecting translational movement of mining machines. One conventional means for effecting such longwall mining machine movement is the use of a chain and sprocket arrangement. See for example, U.S. Pat. Nos. 1,704,667; 3,409,329; 3,418,023; 3,602,549; and 3,753,595. It has also been suggested to employ for longwall machine haulage a sprocket which cooperates with a pocketed guide rod having reciprocating pegs which are adapted to engage the sprocket. See U.S. Pat. No. 3,753,596.

It has also been known to effect haulage of mining machines generally by means of rack and pinion drives. See U.S. Pat. Nos. 563,776; 158,125; and 1,704,667. Rack and pinion drives have also been employed in connection with longwall mining machine haulage. See for example U.S. Pat. No. 3,954,300.

There remains a need for a longwall rack and pinion haulage system which provides more efficient haulage. There is a further need for such system wherein the rack and pinion haulage combination can serve to facilitate delivery of freed mineral from a potentially interfering position within the rack to the desired delivery position on the conveyor.

SUMMARY OF THE INVENTION

The present invention has met the above-described need in connection with longwall mining machine haulage and, more specifically, with respect to rack and pinion longwall mining machine haulage. In a preferred form, the teeth of the pinion are provided with radially outwardly open recesses within which are journaled roller means which may take the form of substantially cylindrical roller members. These roller members project radially outwardly farther than the pinion teeth so as to provide for rolling frictional contact with the rack teeth in lieu of sliding frictional contact therewith. In addition, sections of the root of the rack are provided with sloping surfaces which slope toward the pan of the conveyor. As a result, freed mineral particles impinging upon the rack root will tend to be directed toward the conveyor pan.

It is an object of the present invention to provide longwall mining system wherein haulage is effected by improved rack and pinion means.

It is a further object of this invention to provide such a system wherein rotatably mounted roller elements are secured to the outer extremities of the pinion teeth.

It is another object of the present invention to provide a rack construction which in cooperation with the pinion having roller means will contribute to reduced rack accumulation of freed mineral and increased deposit thereof onto the conveyor.

These and other objects of the invention will be more fully understood from the following description of the invention on reference to the illustrations appended hereto.

DESCRIPTION OF THE PREFERRED EMBODIMENT

Figure 1:
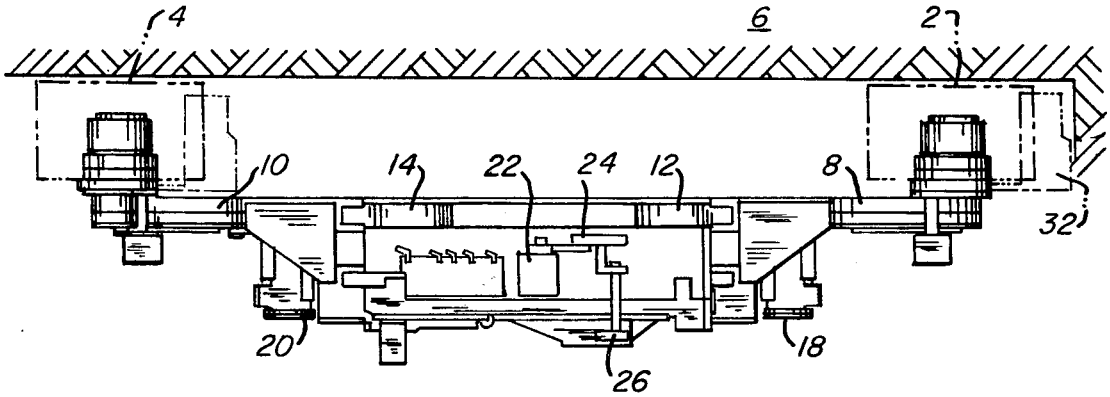
FIG. 1 is a top plan view of a form of longwall mining machine incorporating a form of the haulage drive of the present invention.
Figure 2:
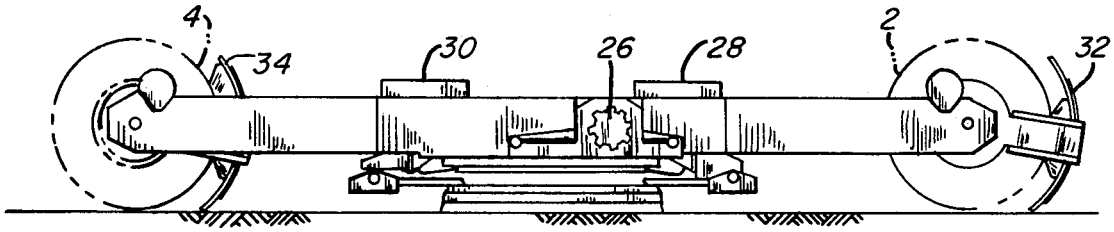
FIG. 2 is a front elevational view of a form of longwall machine incorporating a form of the haulage drive of the present invention.

Referring now more specifically to FIGS. 1 and 2 there is shown the general layout of a longwall mining machine. The machine has a pair of rotary cutter drums 2, 4 adapted to rotate about their central axis in freeing the bedded mineral from the face 6. Each cutter drum 2, 4 is mounted upon a boom member 8, 10, respectively, which is in turn moved in a rotational path by means of cylinders 12, 14 respectively in order to alter the position of the cutter drums 2, 4. Cutter drum motors 18, 20 by means of gearing (not shown) serve to establish rotary movement of the drums 2, 4. Haulage motor 22 drives haulage pinion 26 through transmission means 24. Control means 28, 30 are provided to permit the operator located at the machine to operate the various components. Cowl members 32, 34 are adapted to be rotated about the central axis of the rotary cutter drum 2, 4.

Figure 3:
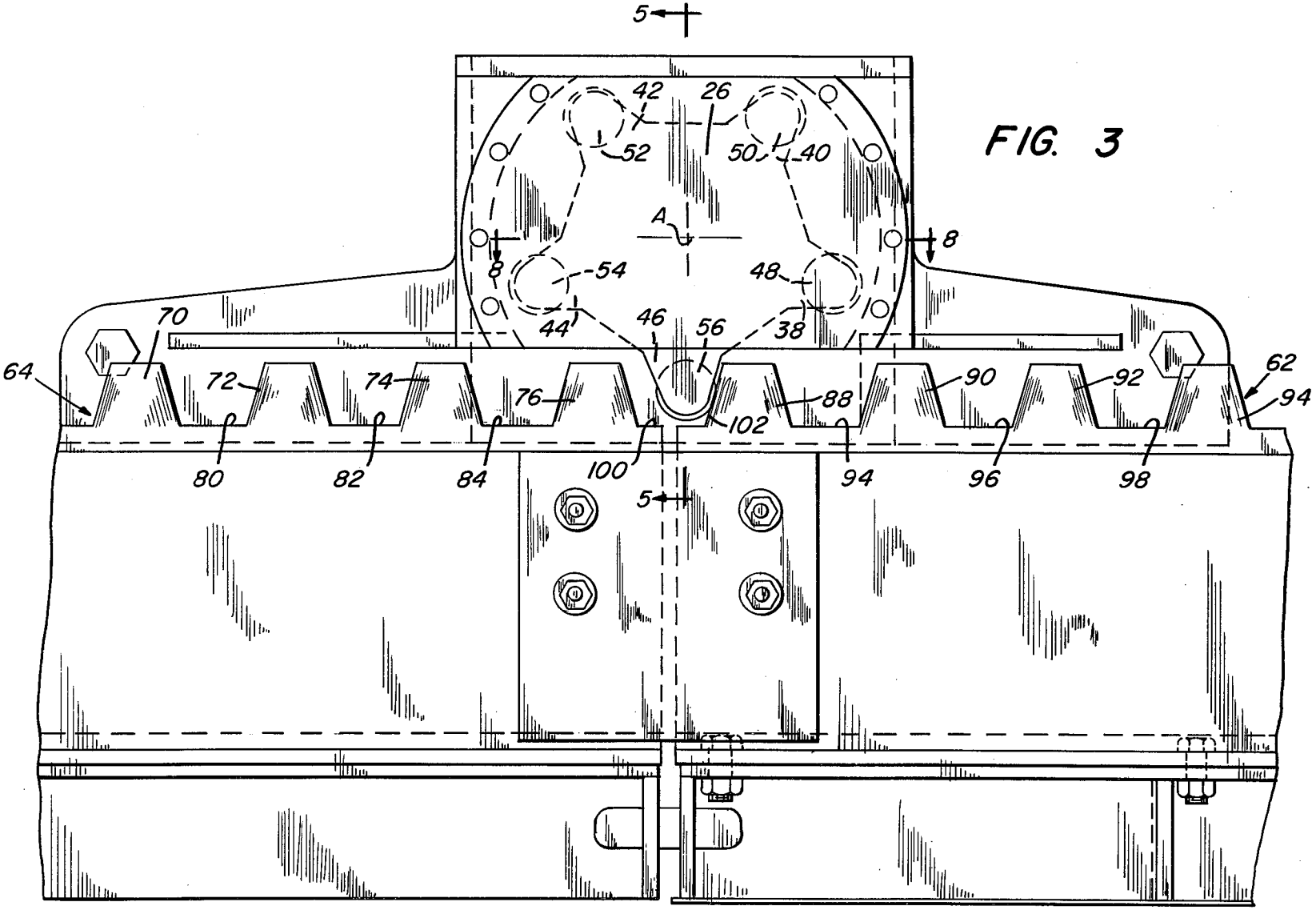
FIG. 3 is a fragmentary front elevational view showing a portion of the rack and pinion of the present invention.

Referring now to FIG. 3 there is shown the pinion 26 which, in the form shown, rotates about axis A and is provided with teeth 38, 40, 42, 44, 46 circumferentially substantially uniformly spaced. Rotatably secured to the teeth 38, 40, 42, 44, 46 in a fashion to be described in greater detail hereinafter, are roller means 48, 50, 52, 54, 56. It will be noted that the roller means 48, 50, 52, 54, 56, 58, project radially outwardly farther than the free ends of teeth 38, 40, 42, 44, 46.

Also shown in FIG. 3 are a pair of rack segments 62, 64 which are secured in such relative position as to define a continuous rack for cooperation with pinion 26. Rack section 64 has alternating teeth 70, 72, 74, 76 and root portions 80, 82, 84. Similarly, rack section 62 has teeth 88, 90, 92, 94 and alternating root portions 94, 96, 98. Teeth 76, 88 cooperate to define root portion 100. As is shown in FIG. 3, the roller 56 when in the lowest position of its orbital travel around axis A remains spaced above root section 100. Also, its contact with surface 102 of tooth 88 results in rolling frictional contact as distinguished from sliding frictional contact which would exist were a conventional pinion construction employed. This results in reduced frictional resistance to movement between piston 26 and the rack segments 62, 64 in effecting haulage of the longwall mining machine.

It will be appreciated, therefore, that rotational movement of pinion 26 which acts in cooperation with the rack 62, 64 will result in translational movement of the mining machine. Rotation of the pinion 26 in a counterclockwise direction will result in movement of the mining machine to the left (as shown in FIG. 3) and rotation from the pinion 26 in a clockwise direction will result in movement of the mining machine to the right (as shown in FIG. 3).

Figure 4:
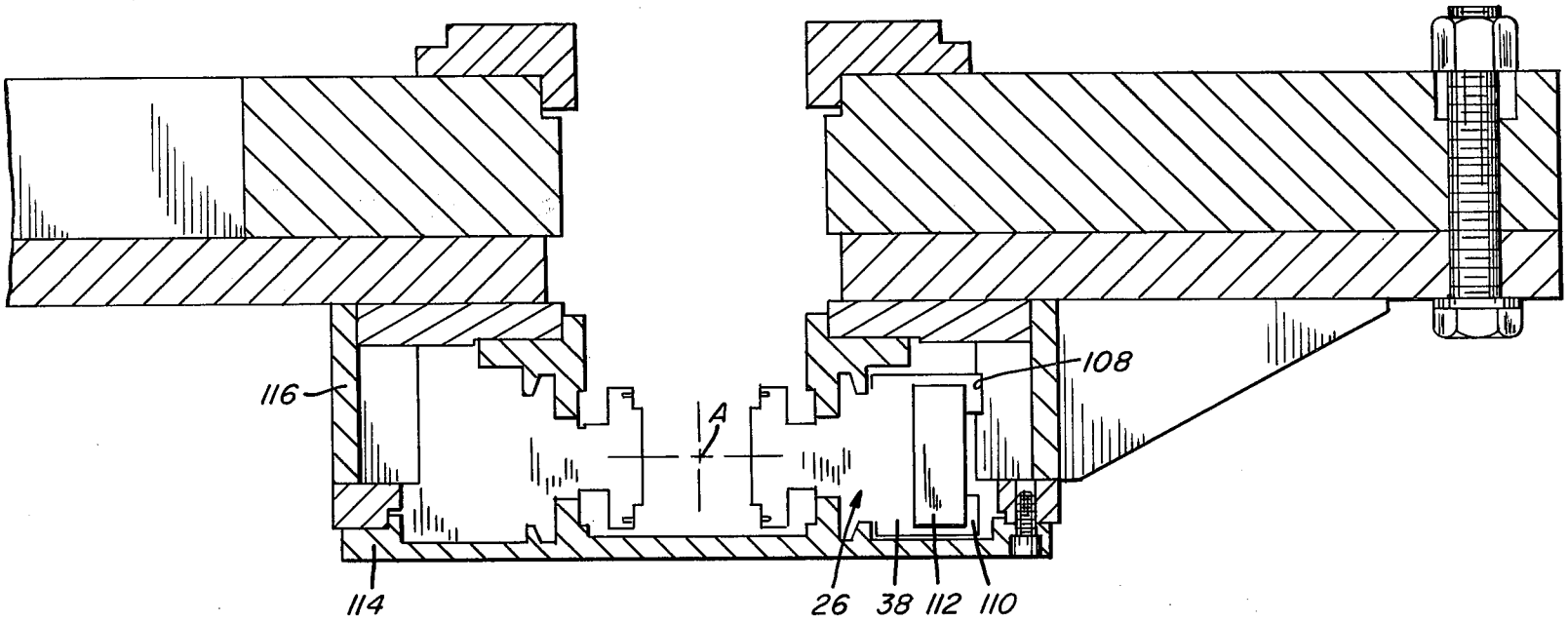
FIG. 4 is a cross-sectional illustration of the housing within which the pinion of the present invention is secured.
Figure 5:
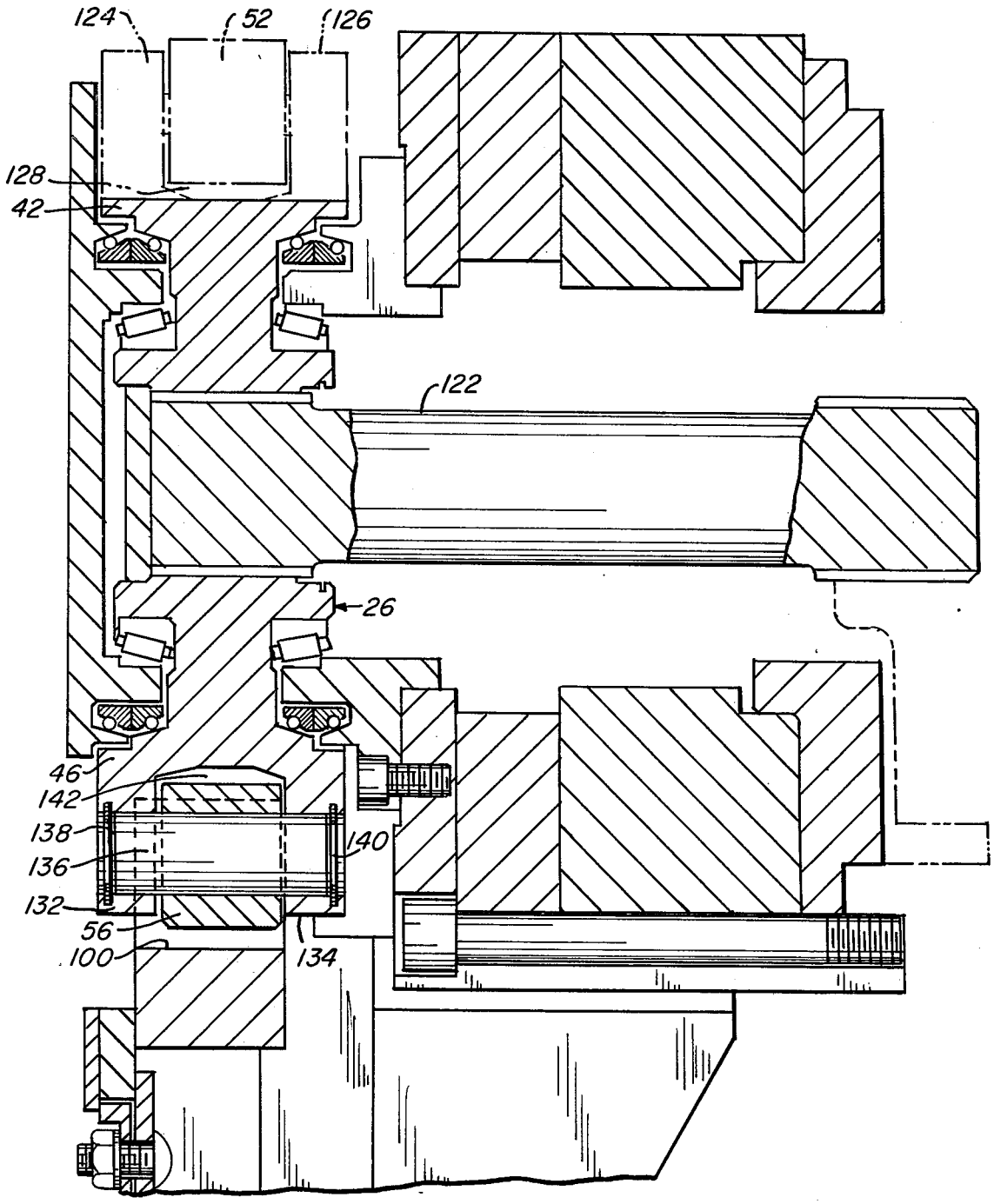
FIG. 5 is a cross-sectional illustration showing the pinion construction taken through 5—5 of FIG. 3.

As is shown in FIGS. 3 and 4, the pinion has its upper portions shielded from the exterior by cover plate 114 in combination with housing member 116. The pinion tooth 38 has an outwardly open recess 112 defined by bifurcated portions 108, 110. Referring to FIG. 5 there is shown pinion 26 is fixedly secured to drive shaft 122 for rotation therewith. Tooth 42 has bifurcated portions 124, 126 defining recess 128 within which roller member 52 is journaled for rotation about an axis generally parallel to the axis of rotation of pinion 26. Tooth 46 has recess 142 defined by bifurcated 132, 134. Recess 142 which is generally radially outwardly open has shaft 136 secured therein with retainer members 138, 140 serving to fixedly secure the shaft 136 therein. Roller member 56 rotates about shaft 136. As is also shown in this figure, the roller member 52, 56 project radially outwardly and laterally farther than the free ends of the teeth 42, 46.

Figure 6:
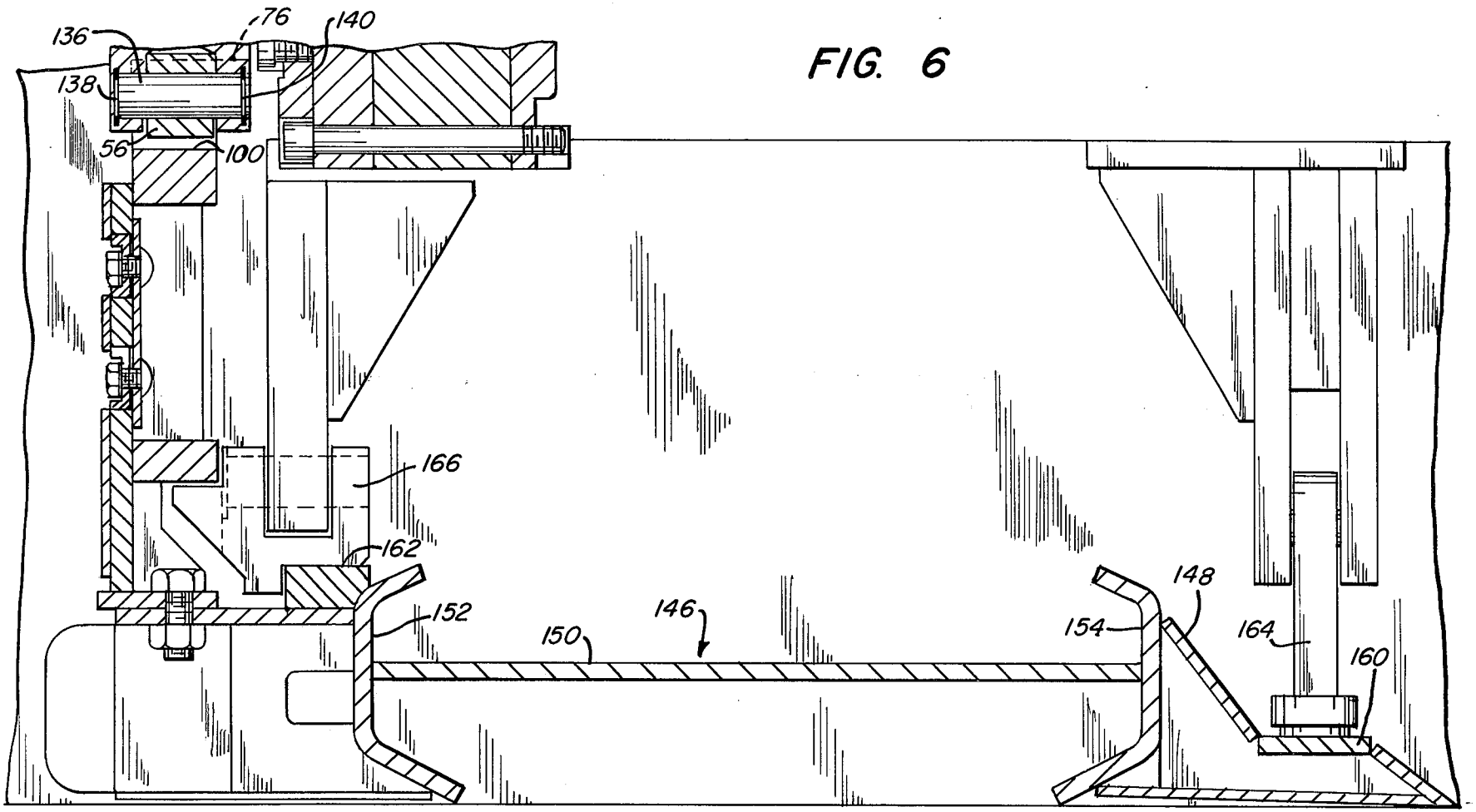
FIG. 6 is a cross-sectional illustration showing a portion of the conveyor unit adapted to cooperate with the unit shown in FIG. 5.

FIG. 6 illustrates, in reduced scale, a portion of the cooperating conveyor system which is adapted to serve as a downward extension of the portion illustrated in FIG. 5. The conveyor pan 146 has a base 150 and a pair of upstanding sidewalls 152, 154 which define a recess for receipt of the freed mineral and suitable conveyor means such as a chain driven flight conveyor (not shown). A ramp plate 148 is disposed along one lateral edge of the pan 146 and the rack is positioned adjacent the other side. Bearing surfaces 160, 162 support lower extremities 164, 166 of the continuous mining machine for relative sliding movement therebetween as the mining machine is subjected to translational movement under the influence of the haulage rack and pinion.

Figures 7, 8, 9:
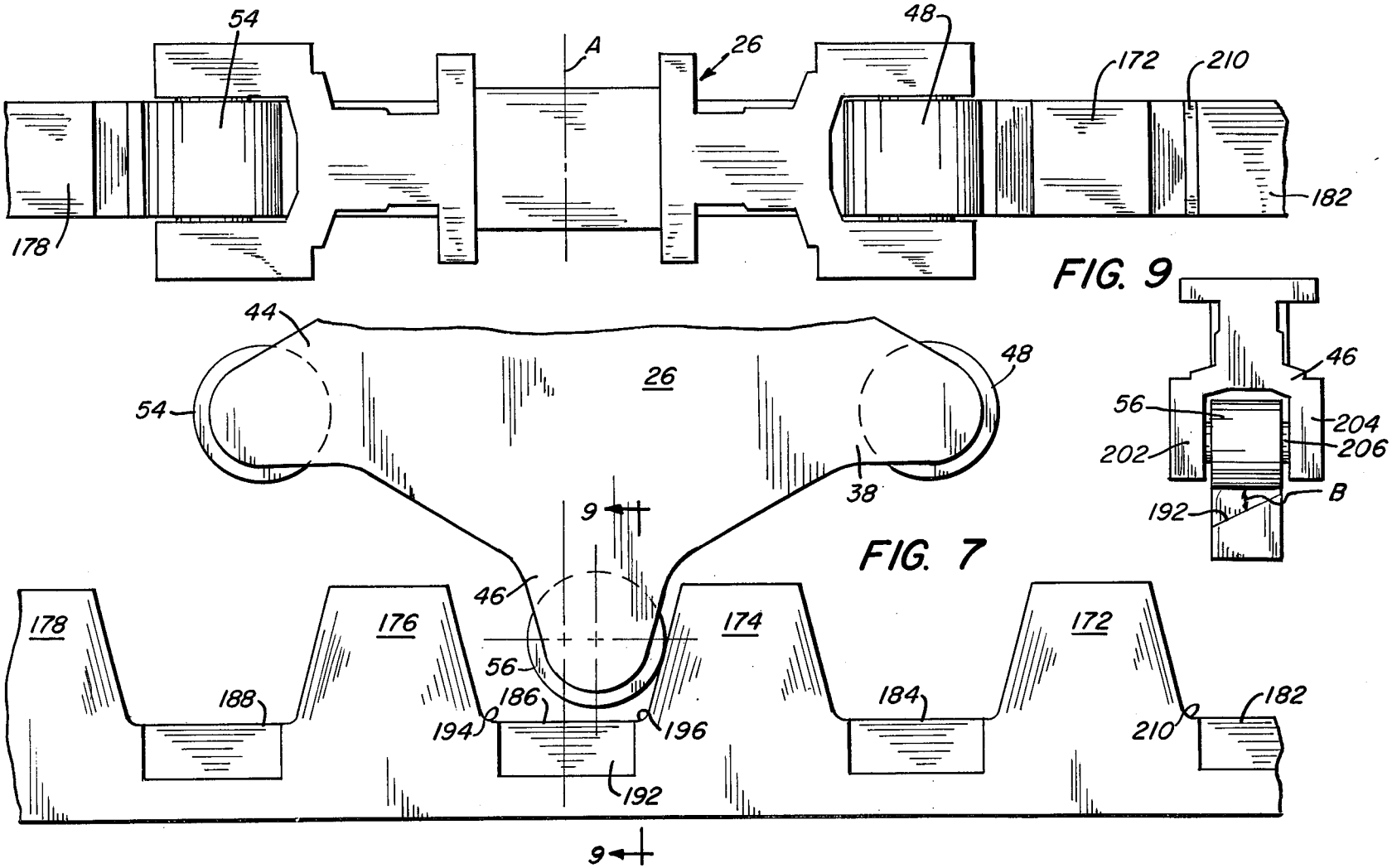
FIG. 7 is a fragmentary cross-sectional illustration illustrating the engagement between one form of rack of the present invention and the pinion of the present invention.
FIG. 8 is a cross-sectional illustration of a portion of the pinion of FIG. 3 taken through 8—8 of FIG. 3.
FIG. 9 is a cross-sectional illustration of the rack and pinion taken through 9—9 of FIG. 7.

Referring now to FIGS. 7 through 9, there is shown in FIG. 7 a fragmentary elevational view of portions of the rack and pinion 26 as viewed from the direction of the conveyor pan. In this embodiment of the invention a modified root is provided for the rack. The rack portion illustrated has teeth 172, 174, 176, 178 with alternating root portions 182, 184, 186, 188. As is shown in FIG. 9, the surface of the root portion 186 has a section 192 which slopes downwardly toward the conveyor pan (not shown in this view) at an angle B with respect to a horizontal plane. As a result, freed material falling upon the sloping section 192 of root portion 186 will tend to fall, under the influence of gravity, toward the conveyor pan. This results in resistance to undesired buildup of freed mineral within the root portions of the rack. Also, the action of rollers such as roller 56 upon the sidewalls of teeth such as 174 will tend to free adhering mineral particles and they will tend to fall either onto the sloping section of root portion 192 or directly onto the conveyor pan. The angle B between a horizontal plane and the sloping section of root portion 192 may advantageously be in the range of about 15 to 45 degrees. In the form illustrated the angle is approximately 30°. It is noted that adjacent to the sloping section 192 of root section 186 there are fillet sections 194, 196 interposed between the sloping section 192 and the adjacent teeth 174, 176. Also, it is noted that the sloping section 192 preferably is the full depth of the root portion and is of a substantially constant slope. As the pinion axis A is so positioned with respect to the rack that the lowermost penetration of the pinion rollers into the rack will preferably not result in contact with a root portion, the angled position of the sloping section 192 does not interfere with mechanical efficiency of the rack and pinion action. Sloping sections of the root portions such as 192 ar preferably provided in all of the root sections.

Figure 10:
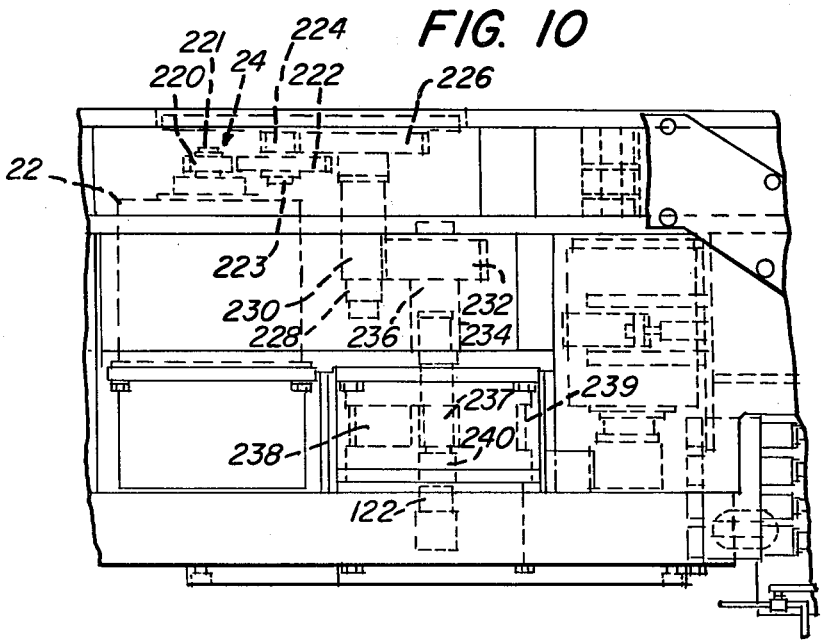
FIG. 10 is a fragmentary plan view of the haulage power and transmission means employed to drive the pinion.

Referring now to FIG. 10 the means for effecting rotation of pinion 26, (which means form no part of the invention per se), will be described. In general, haulage motor 22 by way of transmission means 24 effects rotation of shaft 122 on which the pinion 26 is mounted. As is shown in FIG. 10, output shaft 221 of haulage motor 22 has spur gear 220 fixedly secured thereto. Shaft 223 is oriented generally parallel with respect to shaft 221 and has gear 222 which is intermeshed with gear 220 fixedly secured thereto and gear 224 also fixedly secured thereto. Shaft 228 has gear 226 fixedly secured thereto and intermeshed with gear 224. Shaft 228 also has gear 230 fixedly secure thereto. Gear 232 is secured to shaft 236 and is intermeshed with gear 230, shaft 236 is connected to planetary sun gear 237 by means of splined connection 234. Sun gear 237 meshes with three planet gears 238 (only one being illustrated) which in turn mesh with planetary ring gear 239. Ring gear 239 is connected to shaft 122 by means of splined connection 240. As the output shaft 221 of haulage motor 22 is rotated the transmission means which in the form shown consists of gears 220, 222, 224, 226, 230, 232, 237, 238, 239 and their associated shafts effects the desired speed and power adjustment in order to impart the desired rotary motion to pinion 26 through shaft 122.

It will, therefore, be appreciated that the present invention has provided an effective rack and pinion haulage means for longwall mining systems. The pinion provided with roller means effects more efficient interaction with the rack means. Also, the sloping rack root sections minimize the risk of rack clogage and facilitate more efficient delivery of the freed mineral to the conveyor. All of this is accomplished in an economically advantageous fashion and employs units which are compatible with conventional longwall mining machines.

While for simplicity of disclosure, a pinion element having five teeth has been illustrated, it will be appreciated that a greater or lesser of number of teeth of the type provided in this invention may be employed provided that the circumferential spacing of the teeth corresponds with the dimensioning of the rack and pinion. It is preferred that pinion have about four to eight teeth.

While for simplicity of disclosure a system with rack segments 62, 64 has been illustrated, it will be appreciated that any number of rack segments may be employed in creating the rack. Also, while the use of a single pinion 26 has been shown, the invention contemplates the use of one or more additional such pinions, if desired, with either separate haulage motors driving them or with one motor driving more than one such pinion.

Where particular embodiments of the invention have been described above for purposes of illustration it will be evident to those skilled in the art that numerous variations of the details may be made without departing from the invention as defined in the appended claims.

What is claimed is:

1. A longwall mining conveyor for use with a longwall mining machine comprising an elongated pan, a ramp plate oriented generally parallel to said pan disposed on one side of said pan, rack means oriented generally parallel to said pan disposed on the opposite side of said pan from said ramp plate, said rack means having alternating upward projecting teeth and root portions, and the upper surface of said root portions being sloped downwardly from one lateral side of said rack means to the other lateral side of said rack means toward said conveyor pan, whereby mineral particles falling into said root portions will be directed toward said conveyor pan and will be carried away from such longwall mining machine.

2. A longwall mining conveyor for use with a longwall mining machine comprising an elongated conveyor pan, a ramp plate oriented generally parallel to said pan disposed on one side of said pan, rack means oriented generally parallel to said pan disposed on the opposite side of said pan from said ramp plate, said rack means having alternating upwardly projecting teeth and root portions, said root portions having sections sloping toward said conveyor pans, whereby mineral particles falling onto said root portions will be directed toward said conveyor pan, said sloping root sections being substantially flat, and said sloping root sections extending substantially continuously from one lateral side of said rack means to the other lateral side of said rack means.

3. The longwall mining conveyor of claim 2 including said sloping root sections sloping at about 15 to 45 degrees with respect to a horizontal plane.

4. A longwall mining system comprising a longwall mining machine, a conveyor operatingly associated with said mining machine, said mining machine having a driven haulage pinion, said conveyor having a rack member operatively associated with said pinion, the teeth of said pinion having rotatably mounted roller means secured thereto, said rack member having alternate teeth and root portions, said teeth portions being engagable by said roller means, the upper surface of said root portions being sloped downwardly from one lateral side of said rack member to the other lateral side of said rack member toward said conveyor whereby mineral particles falling into said root portion will be directed toward said conveyor and will be carried away from said longwall mining machine.

5. The longwall mining system of claim 4 having sloping root portions sloping at about 15 to 45 degrees with respect to a horizontal plane.

6. The longwall mining system of claim 5 including the axis of rotation of said pinion being so positioned with respect to said rack means that the exterior surface of said roller means at the lowermost portion of its bodily movement on said pinion remains spaced above said root portions of said rack members.

7. The longwall mining system of claim 6 wherein the axial length of said roller members is substantially equal to the transverse width of said rack teeth.

* * * * *